US008632367B2

(12) United States Patent
Caveney

(10) Patent No.: US 8,632,367 B2
(45) Date of Patent: Jan. 21, 2014

(54) COMMUNICATIONS CONNECTOR WITH A SHORT CONDUCTIVE PATH TO COMPENSATION

(75) Inventor: Jack E. Caveney, North Palm Beach, FL (US)

(73) Assignee: Panduit Corp., Tinley Park, IL (US)

( * ) Notice: Subject to any disclaimer, the term of this patent is extended or adjusted under 35 U.S.C. 154(b) by 43 days.

(21) Appl. No.: 13/379,583

(22) PCT Filed: Jul. 8, 2010

(86) PCT No.: PCT/US2010/041386

§ 371 (c)(1), (2), (4) Date: Jan. 31, 2012

(87) PCT Pub. No.: WO2011/005972

PCT Pub. Date: Jan. 13, 2011

(65) Prior Publication Data

US 2012/0122352 A1 May 17, 2012

Related U.S. Application Data

(60) Provisional application No. 61/224,754, filed on Jul. 10, 2009.

(51) Int. Cl.
*H01R 9/24* (2006.01)

(52) U.S. Cl.
USPC ..... 439/676; 439/941

(58) Field of Classification Search
USPC ..... 439/676, 941
See application file for complete search history.

(56) References Cited

U.S. PATENT DOCUMENTS

| | | | | |
|---|---|---|---|---|
| 7,281,957 | B2 | 10/2007 | Caveney | |
| 7,357,683 | B2 | 4/2008 | Caveney et al. | |
| 7,847,877 | B2 | 12/2010 | Nishikawa et al. | |
| 8,011,972 | B2 | 9/2011 | Caveney et al. | |
| 8,052,483 | B1 * | 11/2011 | Straka et al. | 439/676 |
| 8,342,889 | B2 * | 1/2013 | Straka et al. | 439/676 |
| 2008/0166925 | A1 * | 7/2008 | Caveney et al. | 439/676 |
| 2009/0104821 | A1 * | 4/2009 | Marti et al. | 439/676 |

* cited by examiner

*Primary Examiner* — Gary Paumen
(74) *Attorney, Agent, or Firm* — Christopher S. Clancy; Yuri Astvatsahurov

(57) ABSTRACT

A communication jack is provided with plug interface contacts that have inner and outer contact members. A flexible printed circuit board is connected and supported between the inner and outer members. This results in a short conductive signal pathway between a plug-jack interface and crosstalk compensation provided on the flexible printed circuit board. The plug interface contacts of the jack are specially designed to provide good normal force to plug contacts of a plug inserted into the jack, as well as to securely hold the flexible printed circuit. Standard plug interface contacts may be utilized in combination with a flexible printed circuit board that is connected by welding or soldering to the plug interface contacts.

10 Claims, 3 Drawing Sheets

Detail "A-A"

COMMUNICATIONS CONNECTOR WITH A SHORT CONDUCTIVE PATH TO COMPENSATION

FIELD OF THE INVENTION

The present invention relates generally to electrical connectors, and more particularly, to a modular communication jack having an improved contact arrangement for reducing net crosstalk and decreasing the length of an electrical path from a plug to a flexible compensation circuit.

BACKGROUND OF THE INVENTION

In the communications industry, as data transmission rates have steadily increased, crosstalk due to capacitive and inductive couplings among the closely spaced parallel conductors within the jack and/or plug has become increasingly problematic. Modular connectors with improved crosstalk performance have been designed to meet the increasingly demanding standards. Many of these improved connectors have included concepts disclosed in U.S. Pat. No. 5,997,358, the entirety of which is incorporated by reference herein. In particular, recent connectors have introduced predetermined amounts of crosstalk compensation to cancel offending near end crosstalk (NEXT). In some connectors, stages of compensation are used to account for phase shifts from propagation delay resulting from the distance between the compensation zone and the plug/jack interface. As a result, the magnitude and phase of the offending crosstalk is preferably offset by the compensation, which, in aggregate, has an equal magnitude, but opposite phase from the offending crosstalk.

Recent transmission rates, including those in excess of 500 MHz, have exceeded the capabilities of the techniques disclosed in the '358 patent. Thus, jacks having improved compensation characteristics are needed.

There is a phase shift from an installed plug to the compensation zones in a jack which is dependent on the distance from the plug/jack electrical interface to the printed circuit board (PCB) containing compensation elements, which may be a flexible PCB. This phase shift is proportional to frequency and the effective compensation is dependent on the magnitude of phase shift. It is therefore advantageous to minimize this distance and phase shift to maximize the frequency range over which sufficient compensation is attained.

DETAILED DESCRIPTION OF THE PREFERRED EMBODIMENTS

Figure 1:
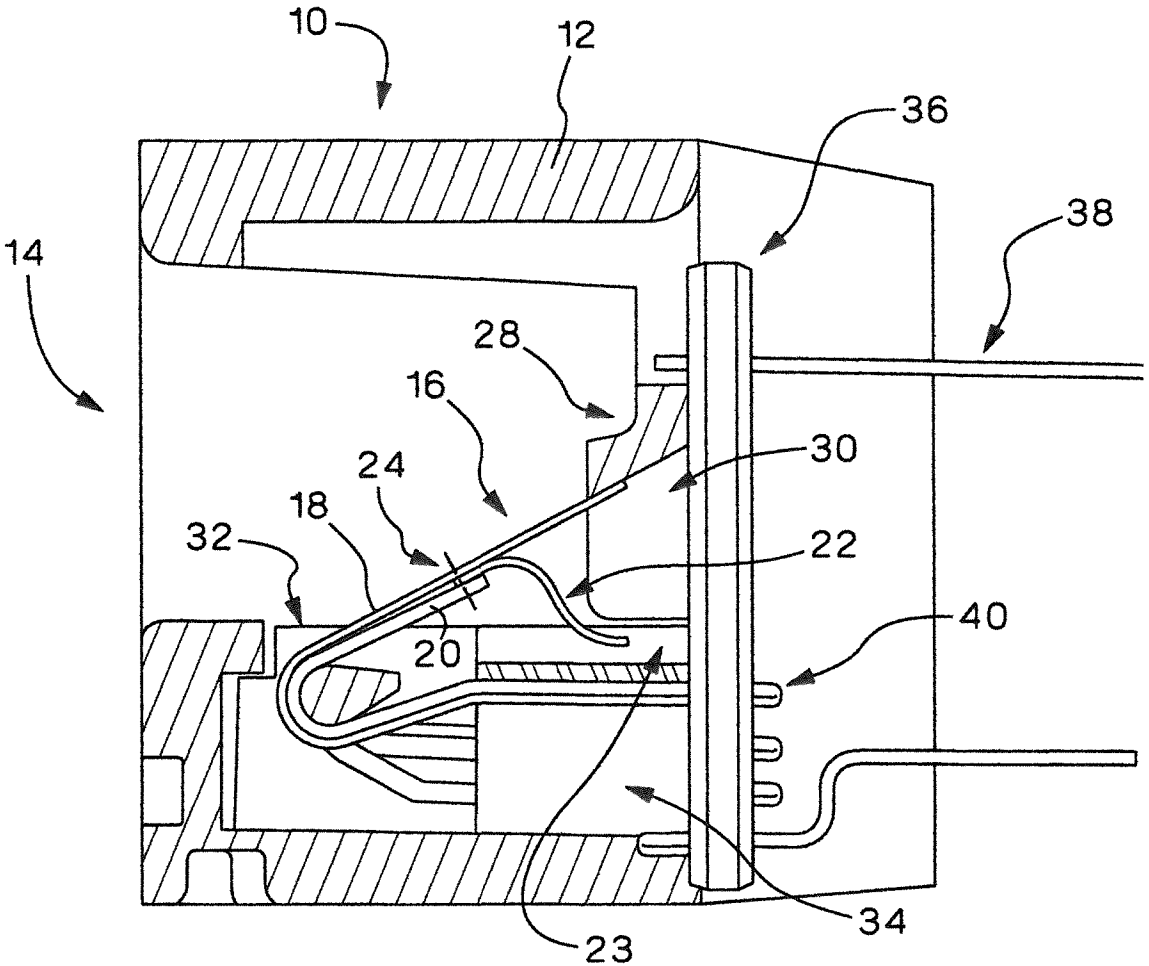
FIG. 1 is a cutaway side view of a communication jack.

FIG. 1 is a cutaway side view of a communication jack 10 according to one embodiment of the present invention. The communication jack 10 has a housing 12 and an opening 14 for accepting a plug. Plug interface contacts 16 are provided within the opening 14 and positioned to make contact with plug contacts of an inserted plug. Although the view of FIG. 1 shows only one plug interface contact 16, in one embodiment of the invention multiple plug interface contacts are provided. In a four-pair Ethernet jack, for example, eight plug interface contacts are provided.

Each of the plug interface contacts 16 comprises two contact members: an outer contact member 18 and an inner contact member 20. An end portion of a flexible circuit board 22 is positioned between the outer contact member 18 and the inner contact member 20 at a plug interface point 24. The plug interface point 24 is where plug contacts 26 (shown in FIG. 2) make electrical contact with the outer contact members 18. Because the flexible circuit board 22 makes electrical and mechanical contact with the outer contact member 18 adjacent to the plug interface point 24, the electrical pathway from the plug contact 26 to the flexible circuit board 22 is very short. An open area 23 is provided for the flexible circuit board 22 to move into as the plug interface contacts 16 are deflected upon insertion of a plug.

The flexible circuit board 22 contains compensation circuitry that compensates for offending crosstalk that arises in other areas of the combination of the plug and jack. Reducing the electrical pathway from the plug contact 26 to the flexible circuit board 22 allows for a very short signal length between the offending crosstalk in the plug contacts 26 and the compensation circuitry on the flexible circuit board 22, increasing the effectiveness of the compensation over a wide range of frequencies.

The combined spring effect of the inner and outer contact members results in the necessary stiffness to provide good normal force between the plug interface contacts 16 and the plug contacts 26. In one embodiment, the outer contact members have a thickness of about 0.008 inches and the inner contact members have a thickness of about 0.013 inches.

A contact stop 28 keeps the plug interlace contacts 16 at the proper angle when a plug is not inserted into the jack 10. An upper comb area 30 keeps the outer contact members 18 properly aligned and separated. Lower combs 32 keep the inner and outer contact members aligned and separated in a front region of the communications jack 10. The plug interface contacts 16 are held in a contact carrier assembly 34. The plug interface contacts 16 are electrically and mechanically connected to a PCB 36, which in turn has insulation displacement contacts (IDC's) 38 connected to it. The IDCs 38 allow termination of a cable to the communication jack 10. Stubs 40 of the outer and inner contact members 18 and 20 are shown extending from the rear of the PCB 36.

Figure 2:
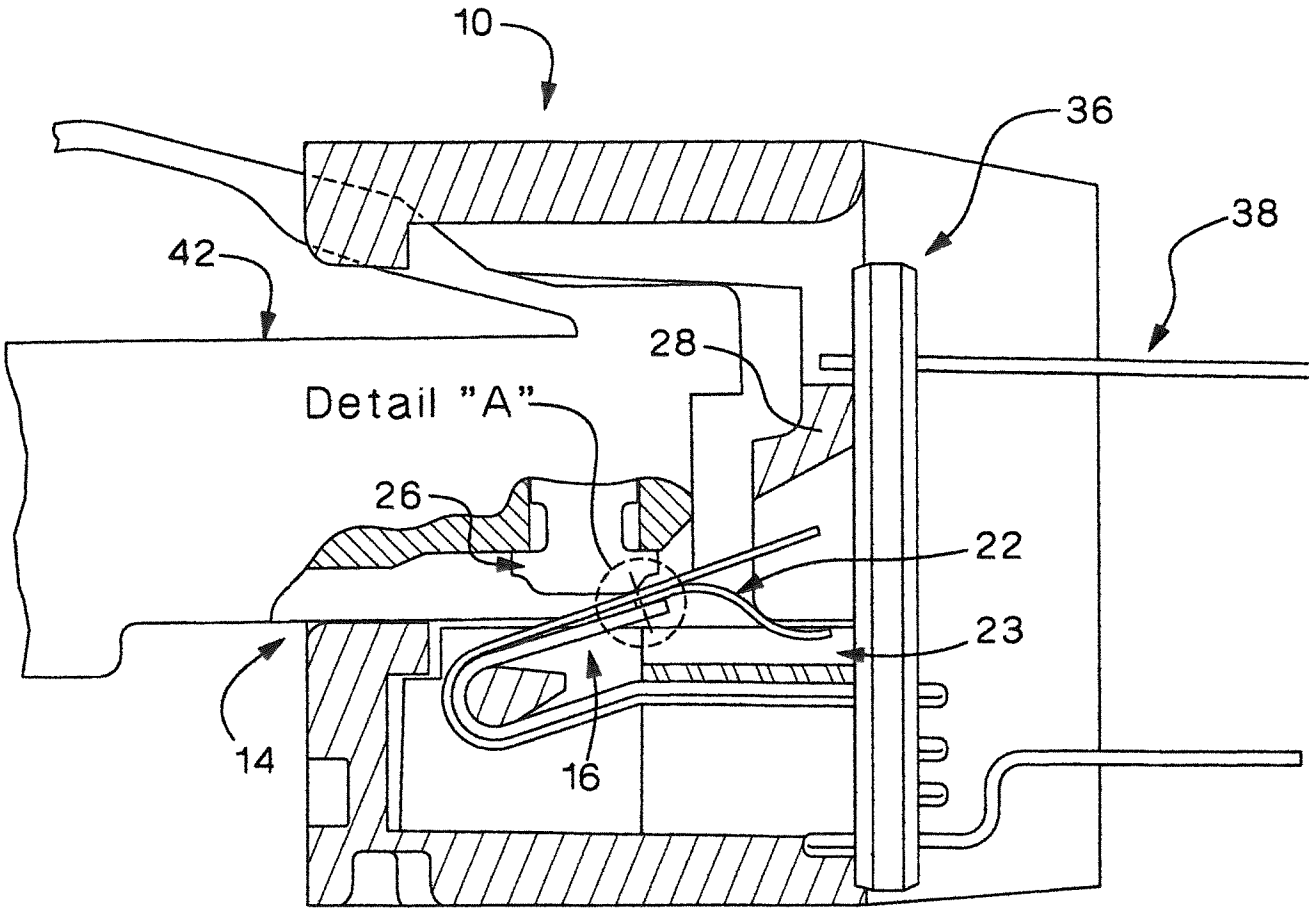
FIG. 2 is a cutaway side view of a communication jack with a plug inserted.

FIG. 2 shows the jack 10 with a plug 42 inserted into the opening 14. Plug contacts 26 make electrical contact with the plug interface contacts 16, and the plug interface contacts 16 are deflected downwardly away from the contact stop 28. The flexible circuit board extends farther into the open area 23 when the plug interface, contacts 16 are deflected.

Figure 3A:
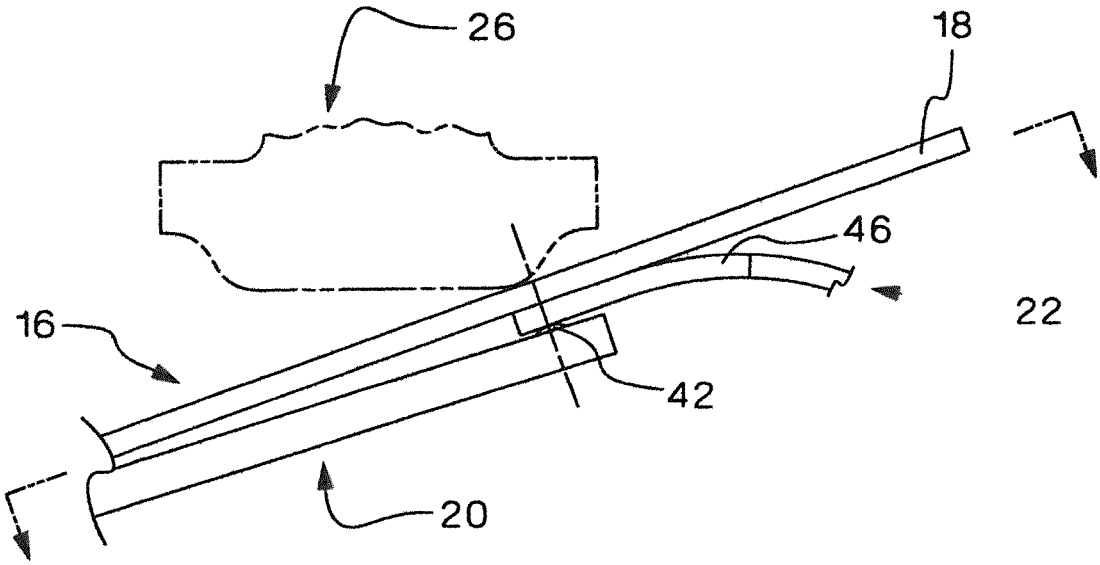
FIG. 3*a* is a detailed view of detail "A" in FIG. 2.
Figure 3B:
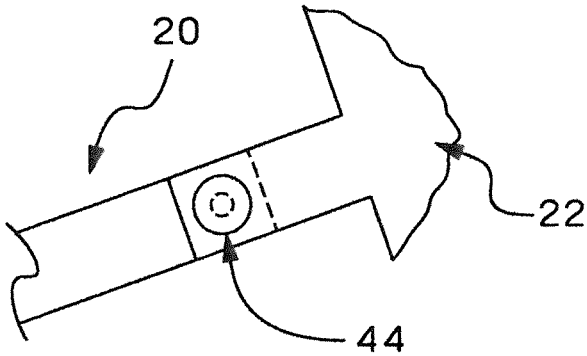
FIG. 3*b* is a top view showing the connection between an inner contact member and a flexible PCB.
Figure 3C:
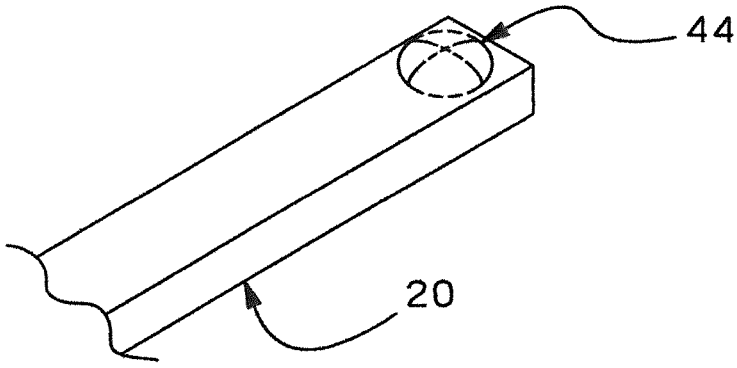
FIG. 3*c* is a perspective view showing a coined projection on an inner contact member.

FIG. 3*a* more clearly shows the area of detail "A" of FIG. 2, where a plug contact 26 contacts the plug interface contact 16. A coined projection 42 provided on the inner contact member 20 focuses the normal force between the plug contact 26 and the plug interface contact 16 for greater electrical continuity. As shown in FIG. 3*b*, the coined projection 42 aligns with a conductive via 44 of the flexible circuit board 22, holding a tab 46 of the flexible circuit board 22 between the inner and outer contact members. The coined projection 42 is more clearly shown in the perspective view of FIG. 3*c*. An eyelet or rivet may be added to the flexible circuit board 22 at the via location to improve the mechanical durability of the flexible circuit board 22 at that location and further to improve the quality of the connection between the flexible circuit board 22 and the plug interface contacts 16.

In another embodiment of the present invention, standard one-layer plug interface contacts are utilized in combination with a flexible printed circuit that is connected to the plug interface contacts by soldering or welding directly, and/or with eyelets or rivets.

The invention claimed is:

1. A communications jack comprising:

a housing defining an opening;

at least one plug interface contact located in the opening, the at least one interface contact comprising an inner contact member and an outer contact member, the outer contact member having a distal end opposite of the opening, the distal end of the outer contact positioned at least partially within an upper comb area;

a flexible printed circuit board containing compensation circuitry, at least a portion of the flexible printed circuit board being positioned between the inner contact member and the outer contact member at a location proximate to a plug interface point; and an open area below the upper comb area, the open area configured to allow the flexible printed circuit board to enter into it when the at least one plug interface contact is deflected due to the insertion of a plug.

2. The communications jack of claim 1 wherein the inner contact member further comprises a coined projection, the coined projection aligned with a conductive via on the flexible printed circuit board.

3. The communications jack of claim 1 wherein the inner contact member is thicker than the outer contact member.

4. The communications jack of claim 1 further comprising a contact stop.

5. The communications jack of claim 1 further comprising lower combs.

6. A communications jack comprising:

a housing defining an opening;

at least one plug interface contact located in the opening, the at least one interface contact comprising an inner contact member and an outer contact member, the inner contact member comprising a spherical coined projection; and a flexible printed circuit board containing compensation circuitry and a conductive via for receiving the spherical coined projection, at least a portion of the flexible printed circuit board being positioned between the inner contact member and the outer contact member at a location proximate to a plug interface point such that the spherical coined projection is aligned with and received within the conductive via.

7. The communications jack of claim 6 further comprising an open area, the open area configured to allow the flexible printed circuit board to enter into it when the at least one plug interface contact is deflected due to the insertion of a plug.

8. The communications jack of claim 6 wherein the inner contact member is thicker than the outer contact member.

9. The communications jack of claim 6 further comprising a contact stop.

10. The communications jack of claim 6 further comprising upper and lower combs.

* * * * *